United States Patent [19]

Springmann

[11] 4,072,023

[45] Feb. 7, 1978

[54] AIR-RECTIFICATION PROCESS AND APPARATUS

[75] Inventor: Helmut Springmann, Geretsried, Germany

[73] Assignee: Linde Aktiengesellschaft, Wiesbaden, Germany

[21] Appl. No.: 658,661

[22] Filed: Feb. 17, 1976

[30] Foreign Application Priority Data

Oct. 3, 1975 Germany ..... 2544340

[51] Int. Cl.[2] ..... F25J 3/04

[52] U.S. Cl. ..... 62/13; 62/30; 62/39

[58] Field of Search ..... 62/38, 39, 30, 13

[56] References Cited

U.S. PATENT DOCUMENTS

| | | | |
|---|---|---|---|
| 2,503,939 | 4/1950 | De Baufre | 62/38 |
| 2,825,212 | 3/1958 | Linde | 62/30 |
| 3,277,655 | 10/1966 | Geist et al. | 62/39 |
| 3,327,488 | 6/1967 | Pervier | 62/39 |
| 3,371,496 | 3/1968 | Seidel | 62/30 |
| 3,375,673 | 4/1968 | Cimler et al. | 62/39 |

*Primary Examiner*—Norman Yudkoff
*Assistant Examiner*—M. J. Mullen
*Attorney, Agent, or Firm*—Karl F. Ross

[57] ABSTRACT

An air-rectification system comprises a two-stage low-temperature separation column of the LINDE-FRÄNKL type connected to a heat exchanger whereby air is cooled on passage through the heat exchanger and is introduced into the high-pressure stage of the column, oxygen and nitrogen are fed from the high-pressure stage to a low-pressure stage of the column and are separated therein to form low-temperature product oxygen and nitrogen which are warmed by passage separately through the heat exchanger, and a gas stream, representing a heat-balancing stream (balance stream) is drawn from the rectification column and passed through the heat exchanger, in which one of the gas streams between the heat exchanger and the rectification column is subject to low-temperature compression. The compressed gas stream may be the balance gas stream, the incoming air after cooling in the heat exchanger or one of the product gas streams.

9 Claims, 4 Drawing Figures

AIR-RECTIFICATION PROCESS AND APPARATUS

FIELD OF THE INVENTION

The present invention relates to a method of and apparatus for the separation of air into its major components, namely, oxygen and nitrogen using a LINDE-FRÄNKL type of two-stage air-rectification column and heat-exchanger means associated therewith.

BACKGROUND OF THE INVENTION

Air separation using air-rectification columns generally comprises a two-stage LINDE-FRÄNKL type of separation column in association with heat-exchanger means which can be of the reversing (REVEX) or regenerative (REGEN) type.

Basically, these systems operate by cooling an air-stream drawn from the atmosphere in the heat exchanger (e.g. thereby removing high boiling point and high freezing point impurities such as water vapor and carbon dioxide), introducing the cold air into the bottom of a multistage high-pressure lower column of an air-rectification installation, carrying out a preliminary separation of air and oxygen in this high pressure stage of the column with refluxing so that oxygen is primarily drawn from the sump of the high-pressure stage and nitrogen is predominantly drawn from the top of the high-pressure stage, introducing this nitrogen and oxygen into a low-pressure upper stage of the column in which the top of the high-pressure stage, functions as part of a refluxing-boiler arrangement for the low-pressure upper stage, recovering nitrogen in a purity stage from the top of the low-pressure upper portion of the column, recovering oxygen from the lower portion of the upper low-pressure column, passing the product nitrogen and oxygen through the heat-exchanger means to provide the "cold" therein necessary to cool the aforementioned incoming gas stream, and drawing from the column a balance gas stream which is expanded, e.g. in an expansion turbine to provide a quantity of "cold" necessary to balance heat incursions into the system.

The balance stream can also be passed through the heat-exchanger means. Systems of this type and even more sophisticated air-rectification installations are described in PERRY'S CHEMICAL ENGINEERS' HANDBOOK (McGraw Hill Book Co., 1963, see especially page 28 of chapter 12) in which the LINDE double column is described in detail. Reference may also be made to PLANCK HANDBUCH DER KÄLTETECHNIK, 1957, 1. Auflage, Volume VIII, pages 202, 203. Reference may also be made to the recently published discussion entitled "Large Air Separation Units Plants", AMERICAN SOCIETY OF MECHANICAL ENGINEERS 74-WAPID-8 in this connection.

In most systems for the separation of air into nitrogen and oxygen by two-stage low-temperature rectification using the LINDE double column mentioned above, the air to be rectified is cooled to the temperature necessary upon introduction into the lower or high-pressure stage of this column in a reversing main heat exchanger. Impurities such as water and carbon dioxide are frozen out of the air stream. By periodic interchange of the flow passages of the heat exchanger, e.g. by functional interchange of a pair of alternately effective heat exchanger sections or of a common heat exchanger or by the use of two interchangeable but separate heat exchanger units, a sparging gas is passed through the passages containing the frozen-out impurities which are evaporized and carried out of the apparatus with the sparging gas. The carbon dioxide, for example, is sublimated into the sparging gas.

For thermodynamic reasons, the re-evaporation of the frozen-out impurities require small-temperature differential between the incoming air and the sparging gas (see especially the aforementioned pages of "PLANCK'Handbook of Cold Techniques").

In order to maintain the small-temperature differentials in the main heat exchanger, it is necessary in many cases to provide the aforementioned balance stream which can comprise a gas drawn from the pressure stage of the LINDE double column, the balance stream being warmed in the cold part of the main heat exchanger in indirect heat-exchanging relationship with the incoming air.

To recover at least in part the mechanical energy of pressurization, the balance stream is usually expanded in an expansion turbine thereby converting the potential energy of pressurization of this gas into kinetic energy of work.

The "cold" resulting from the expansion of the gas is necessary in small installations to compensate for the insulation losses. In large air-rectification plants in which relatively small cold loss is encountered, the expansion produces more cold than is necessary to cover the losses. Because of the minimum insulation losses of large installations, the energy released is not effectively utilized, especially when one or more of the separation products is not required in a liquid state.

For the purposes of this description, reference will be made to the generation of "cold", the loss of "cold" and the like as is common in connection with low-temperature air separation. This is, of course, equivalent to the abstraction of heat, the incursion of heat into the system, etc.

In order to round out the state of the art with respect to two-stage air separation systems, it should be noted that it is also known to compress hot gases to be passed through the heat exchanger or warm gases emerging therefrom and even to compress cold oxygen within the network connected with the two-stage separating column. The compression of warm oxygen is intended to make this product available in a compressed state. The compression of warm air before it enters the heat exchanger is intended to provide the pressure subsequently needed at the high pressure stage of the LINDE double column and the compression of cold oxygen is intended to permit the latter to be used economically in the two-stage column where higher pressures are required.

OBJECTS OF THE INVENTION

It is the principal object of the present invention to provide a method of and an apparatus for the better utilization of surplus cold produced in an air-rectification installation.

Still another object of the invention is to provide an air rectification installation in which the utilization of energy is improved.

Still another object of the invention is to provide an improved method of operating an air-rectification installation utilizing the LINDE double column.

SUMMARY OF THE INVENTION

These objects and others are attained, in accordance with the present invention, in a system in which one of three gas streams between the heat exchanger and the LINDE double column is compressed in a cold state at least in part by the energy gained from expansion of the balance stream, the gas streams which may be compressed being either the incoming air after it has been cooled in the heat exchanger, the product oxygen to be discharged from the installation immediately before it is passed through the heat exchanger and the product nitrogen to be discharged from the installation immediately before it is passed through the heat exchanger. Thus, the compressor is provided in one of the ducts between the LINDE double column and the cold side of the heat exchanger means according to an essential feature of this invention.

The invention is based upon the fact that a cold gas stream requires substantially less energy per unit of mass flow for compression than a warm gas stream. In prior-art processes, compression of the gas stream has invariably been carried out upon the stream in the warm state, i.e. at its transformation temperature since the heat generated by compression can be abstracted by heat exchange at transformation between two states. Only in the system described in the ASME publication to the best of my knowledge, is there a discussion of the possibility of compressing cold oxygen although here the oxygen is not compressed as required by the present principles between the cold end of the heat exchanger and the two-stage air separation column with energy derived totally from the expansion of a balance gas stream after it has traversed the heat exchanger.

Thus, to the extent that an excess of cold is generated in an air-separation installation, this excess can be utilized to compress one of the aforementioned gas streams in a cold state to obtain the desirable energy characteristics of compression at low temperatures.

The invention may be carried out in various ways depending upon the particular gas stream to be compressed and/or how the balance gas stream is to be drawn from the column or returned thereto. For example, it has been found to be advantageous, when oxygen under pressure is to be obtained as a product of the installation, to introduce a compressor into the product-oxygen line between the LINDE double column and the heat exchanger so that the product oxygen is compressed before it is warmed in this heat exchanger. When the ultimate product of the installation is to be a substantially pressureless product gas (oxygen or nitrogen), the incoming air stream, after it has been cooled in the heat exchanger, is compressed, thereby conserving energy which would otherwise be required for the compression of air at the transformation temperature.

From the viewpoint of practically carrying out the process of the invention, it has been found to be desirable to connect the cold-gas compressor directly mechanically with an expansion turbine as noted previously.

According to a feature of the invention, another portion of the balance gas stream can be used to provide work utilized otherwise in the compression of the cold gas stream, e.g. for the production of electricity usable elsewhere in the plant.

The process of the invention is characterized especially by avoiding the production of excessive cold in an air-rectification installation in which the incoming air is cooled in a reversing heat exchanger (REVEX) or a regenerative heat exchanger (REGEN) and the balance stream of gas is drawn from the LINDE double column, is heated in the main heat exchanger and is expanded in a turbine. At least part of this expansion energy is used to compress one of the aforementioned cold gas streams.

BRIEF DESCRIPTION OF THE DRAWING

The above and other objects, features, and advantages of the present invention will become more readily apparent from the following description, reference being made to the accompanying drawing in which.

SPECIFIC DESCRIPTION

Figure 1:
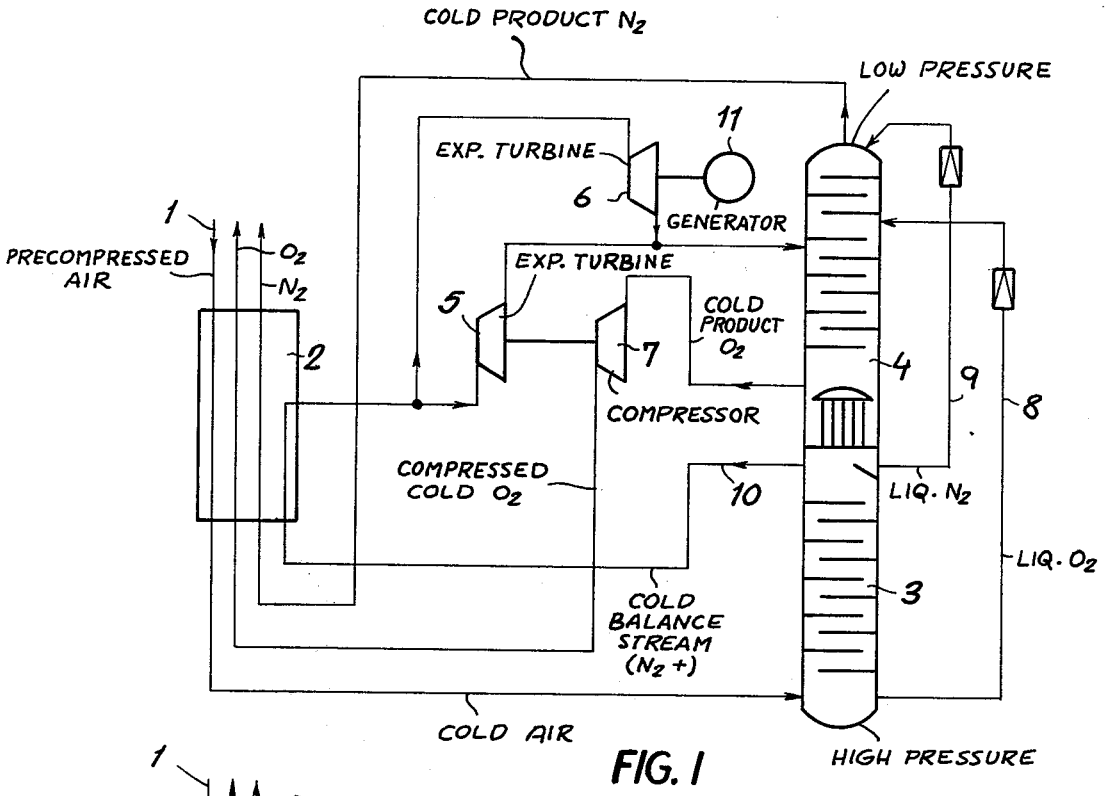
FIG. 1 is a flow diagram of an air-rectification installation with a two-stage LINDE double column in which the product oxygen is compressed in the cold state.

In the following description and specific examples, reference numerals which are common to the several Figures are utilized to represent similar functioning elements. To the extent that the operation of any part of the system is not described in detail for any embodiment, reference may be made to the corresponding description of another embodiment therefor. Further, the two-stage column utilized in all of the embodiments is that described in the cited portion of PERRY'S CHEMICAL ENGINEERS' HANDBOOK as the LINDE double column and the operation of the column is identical to that of the LINDE double column described in the cited work.

In FIG. 1 an air inlet 1 is connected to a REVEX heat exchanger 2 upstream of a LINDE double column 3, 4 whose high-pressure stage is represented at 3 and low-pressure stage is shown at 4. An expansion turbine 5 for the balance stream is mechanically coupled to a compressor 7 while another expansion turbine 6 drives an electrical generator 11. The balance stream conduit is represented at 10 and lines 8 and 9, provided with expansion valves, respectively feed oxygen and nitrogen from the high-pressure stage to the low-pressure stage of the column.

Compressed and prepurified air is fed at 1 into the main heat exchanger or REVEX 2 and is cooled therein to constitute one of the cold gas streams which can be compressed according to the invention. In the embodiment of FIG. 1, however, the cold air is introduced into the high-pressure stage 3 of the LINDE double column. Crude fractions of oxygen and nitrogen are drawn at 8 and 9 from the high-pressure stage 3 of the column and are introduced after throttling and expansion into the low-pressure stage 4 of the column in which refluxing separation of the gases takes place.

Gaseous high-purity oxygen is drawn from the base of the low-pressure column and is compressed in the cold state by compressor 7 before being passed through the heat exchanger 2. Gaseous nitrogen, forming a balance stream, is drawn at 10 from the top of the high-pressure stage 3, is warmed in the cold part of the REVEX 2 and is expanded in the expansion turbines 5 and 6 before being returned at an intermediate portion of the low-pressure column 4. The mechanical energy recovered at turbine 6 is used to generate electricity at 11 to supply the electrical energy requirements of the plant. The mechanical energy recovered at the turbine 5 is utilized to operate the compressor 7 which compresses the gaseous product oxygen which emerges from the heat exchanger 2 after warming. Product nitrogen drawn from the top of the low-pressure column 4 is likewise passed through the REVEX 2.

Figure 2:
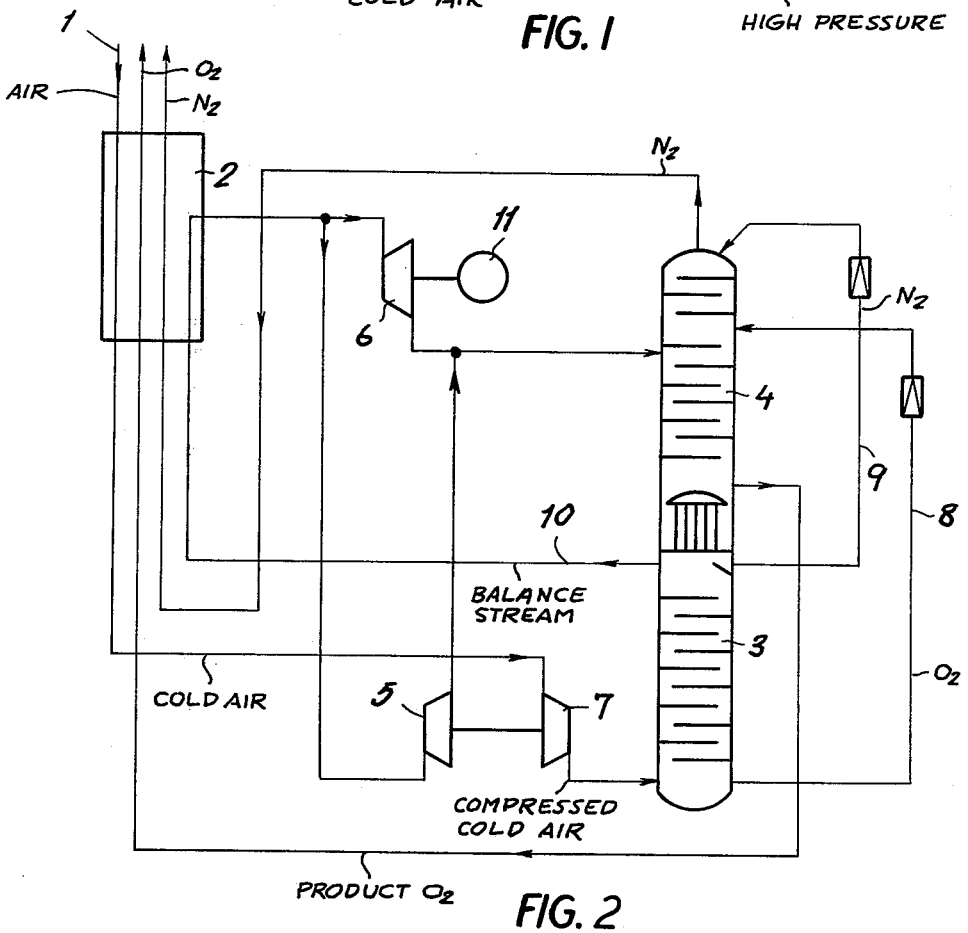
FIG. 2 is a diagram of an installation otherwise similar to FIG. 1 except that incoming air is compressed.

In FIG. 2, the cooled gaseous incoming air is further compressed by the compressor 7 before it is introduced into the sump of the high-pressure stage 3 of the column while the product oxygen is led through the REVEX 2 without compression.

Figure 3:
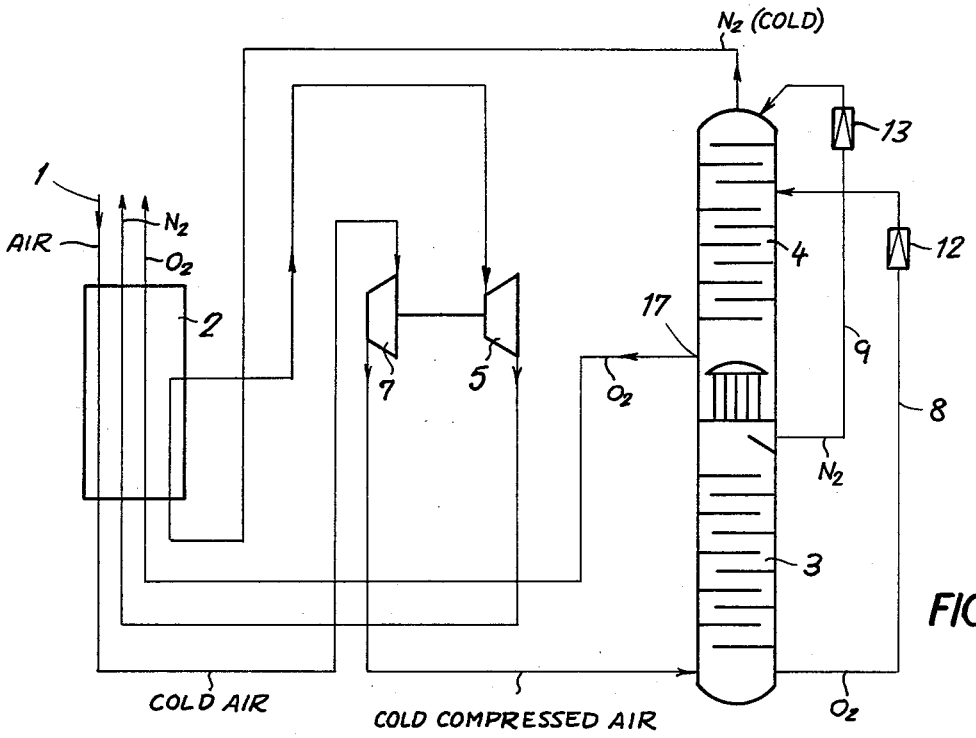
FIGS. 3 and 4 represent other versions of the system in which incoming air is compressed.

In the embodiment of FIG. 3, in which no second turbine is provided to drive a generator, no balance stream is used and the expansion turbine 5 is operated by the product nitrogen before it is passed through the REVEX 2 to compress at 7 the incoming air. The oxygen is led at 17 directly through the REVEX 2 and the expansion valves are represented at 12 and 13 for lines 8 and 9.

Figure 4:
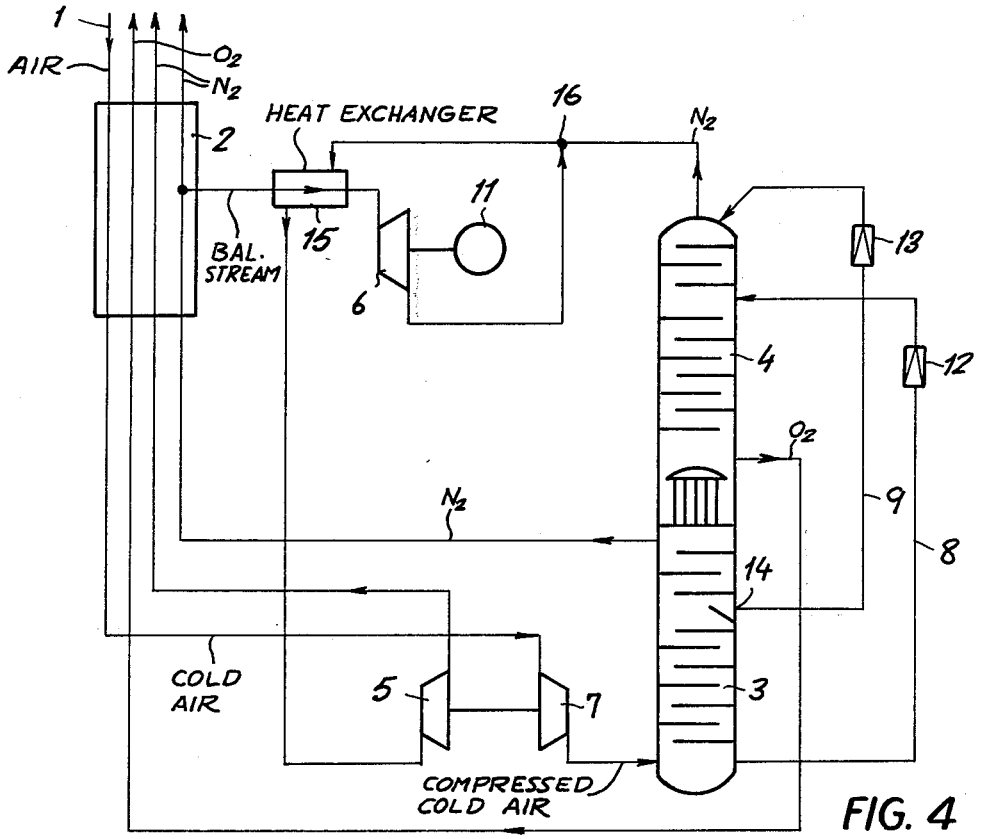

In the embodiment of FIG. 4, the balance stream is tapped through an indirect heat exchanger 15 before being passed into the expansion turbine 6 to drive the generator 11, the balance stream being fed back to the product nitrogen stream at 16. All of the product nitrogen stream is passed from the heat exchanger 15 through the expansion turbine 5 which drives the compressor 7 to compress the previously cooled incoming air before it is introduced into the high-pressure stage 3 of the double column. In this case the double column is formed with an outlet 14 for the nitrogen conveyed via line 9 and throttle valve 13 to the top of the low-pressure stage 14 while the balance stream is drawn from directly below the reflux boiler between the two stages and consists of impure nitrogen, a portion of which is returned to the heat exchanger 15 while the remainder is discharged through the heat exchanger 2.

SPECIFIC EXAMPLES

EXAMPLE 1 - FIG. 3

Prepurified air is introduced at a pressure of 17 bar at a rate of 10,000 cubic feet per minute at standard temperature and pressure (SCFM) to the main heat exchanger 2. The air is cooled therein to 125° K. The air is further compressed in the compressor 7 to 29 bars and is thereby warmed to a temperature of 160° K before it is introduced into the high-pressure stage 3 of the LINDE double column.

From the sump of the high-pressure stage 3 of the LINDE double column, 5800 SCFM of a liquid fraction containing 34.5% by weight oxygen is withdrawn and fed to line 8 into the low-pressure stage 4 of the column after throttling to the pressure of the low-pressure stage (11.2 bar).

Liquid nitrogen with the residual oxygen content of 2.2% by weight is drawn from the head of the pressure stage 3 at a rate of 4200 SCFM and is fed through line 9 after throttling at 13 into the heat of the low-pressure stage 4 to the pressure thereof.

From the head of the low-pressure stage 4 of the LINDE double column, 8400 SCFM of a gas is withdrawn that consists of 93% nitrogen, 6.3% oxygen and 0.7% argon. This gas is supplied to the cold part of the heat exchanger 2 and is withdrawn at an intermediate location thereof at a temperature of 140° K and is expanded in turbine 5 to a pressure of 1.4 bar. The mechanical energy thus gained is used to drive the compressor 7. The gas stream leaving the turbine 5 has a temperature of 86.5° K and is passed through the entire length of the heat exchanger 2. 1600 SCFM of product oxygen at a purity of 98% is withdrawn at 17 from above the sump of the low-pressure stage 4 in a gaseous state and is warmed in the heat exchanger 2 before being discharged.

EXAMPLE 2 - FIG. 4

10,000 SCFM of prepurified air compressed with 7 bars is introduced into the heat exchanger 2 and is cooled therein to 107° K. The air is further compressed in compressor 7 to 9.3 bars thereby being warmed to 119° K. The air is subjected to rectification in the double column 3, 4.

From the sump of the high-pressure stage 3, 5100 SCFM of a liquid fraction containing 37.5% oxygen is withdrawn and supplied to the low-pressure stage via line 8 and a throttle 12 at a pressure of 2.65 bar. 2300 SCFM of liquid nitrogen with a residual oxygen content of 8% is recovered at point 14 of the high-pressure stage 3 and is expanded with throttling via the valve 13 and line 9 into the head of the low-pressure stage 4 of the column. From the head of the high-pressure stage 3, 2600 SCFM of gaseous pure nitrogen with a residual oxygen content of 10 parts per million is withdrawn and introduced into the cold end of the main heat exchanger 2. A portion of 800 SCFM of this nitrogen stream is heated to the transformation temperature and is discharged as the product from the installation. Another portion (1800 SCFM) is diverted at an intermediate location from the heat exchanger (at a temperature of 154° K) and is cooled in an auxiliary heat exchanger 15 to 127° K before it is introduced into the turbine 6 for expansion to a pressure of 2.5 bar. This cools the gas to 94° K at which temperature it is returned at 16 to the pure nitrogen stream.

The mechanical energy recovered at turbine 6 is used to operate the generator 11 at an output of 30 kWh. At point 16, the expanded gas is combined with 6000 SCFM of the head nitrogen drawn from the low-pressure stage 4 and having the following composition:

86.9% nitrogen, 11.7% oxygen and 1.4% argon. The combined gases are warmed in the auxiliary heat exchanger 15 to 112.5° K and are expanded in turbine 5 to 1.2 bars. This reduces the temperature to 96° K at which the gas is passed through the heat exchanger 2 and discharged from the installation. The expansion energy of turbine 5 drives the compressor 7.

I claim:

1. A method of separating air comprising the steps of:

cooling precompressed and prepurified air in a main heat exchanger to produce a first cold air stream;

rectifying said first cold airstream to separate it into an oxygen-containing liquid and a nitrogen-containing liquid in a high-pressure stage of a LINDE double column, said liquids being introduced into a low-pressure stage of said column producing a cold gas stream consisting predominantly of nitrogen and a cold gas stream consisting predominantly of oxygen;

passing said cold gas streams through said heat exchanger from the cold end thereof to the warm end thereof;

drawing a balance cold gas stream from said column between ends of said column and passing it through at least part of said heat exchanger from said cold end of said heat exchanger;

expanding at least part of one of said cold gas streams in an expansion turbine; and compressing another of said streams between said column and said cold end of said heat exchanger in a compressor driven by said expansion turbine, said other cold stream being said third cold stream.

2. A method of separating air comprising the steps of:

cooling precompressed and prepurified air in a main heat exchanger to produce a first cold airstream;

Rectifying said first cold airstream to separate it into an oxygen-containing liquid and a nitrogen-containing liquid in a high-pressure stage of a LINDE double column, said liquids being introduced into a low-pressure stage of said column producing a cold gas stream consisting predominantly of nitrogen and a cold gas stream consisting predominantly of oxygen;

passing said cold gas streams through said heat exchanger from the cold end thereof to the warm end thereof;

drawing a balance cold gas stream from said column between ends of said column and passing it through at least part of said heat exchanger from said cold end of said heat exchanger;

expanding at least part of one of said cold gas streams in an expansion turbine; and compressing another of said streams between said column and said cold end of said heat exchanger in a compressor driven by said expansion turbine, said other cold stream being said first cold stream.

3. The method defined in claim 2, further comprising the step of expanding another part of said one of said cold streams in a further expansion turbine and generating electrical energy with said further expansion turbine.

4. The method defined in claim 2 wherein said one of said cold gas streams is said balance cold stream.

5. The method defined in claim 4, further comprising returning said balance cold gas stream to said column after it has traversed said expansion turbine.

6. The method defined in claim 2, further comprising the step of driving another expansion turbine with said balance gas stream and generating electricity therewith, the balance gas stream after operating the last-mentioned turbine being combined with said one of said cold gas streams to drive the first-mentioned turbine.

7. The method defined in claim 2 wherein said one of said cold streams is a nitrogen stream.

8. An air-separation installation comprising:

a LINDE double column having a high-pressure stage surmounting a low-pressure stage;

a main heat exchanger having a warm end and a cold end;

means for introducing air into said main heat exchanger at said warm end;

means for conducting cold air as a first cold gas stream from said cold end of said heat exchanger to the high-pressure stage of said column for rectification therein into a nitrogen-containing fluid and an oxygen-containing fluid;

means for introducing said fluids from said high-pressure stage of said column into said low-pressure stage of said column for rectification therein into nitrogen and oxygen;

means for conducting nitrogen as a second cold gas stream from said low-pressure stage of said column to said heat exchanger at said cold end thereof;

means for conducting oxygen from said low-pressure stage of said column as a third cold gas stream to said heat exchanger at said cold end thereof;

means for discharging oxygen and nitrogen separately from the warm end of said heat exchanger;

means for drawing from said column a balance cold gas stream and passing it through only a portion of said heat exchanger from said cold end thereof;

an expansion turbine traversed and driven by one of said gas streams; and a compressor connected to and driven by said expansion turbine and disposed between said cold end of said heat exchanger and said column for compressing another of said cold gas streams.

9. The installation defined in claim 8 wherein said compressor is connected in the means conducting said first cold gas stream from the cold end of said heat exchanger to said column.

* * * * *